United States Patent [19]

Vines

[11] 4,249,184

[45] Feb. 3, 1981

[54] ANTENNA ARM AND METHOD FOR MAKING THE ARM

[76] Inventor: James K. Vines, 611 Farmview Rd., Park Forest South, Ill. 60466

[21] Appl. No.: 36,631

[22] Filed: May 7, 1979

Related U.S. Application Data

[62] Division of Ser. No. 887,354, Mar. 16, 1978.

[51] Int. Cl.³ ..... H01A 19/12

[52] U.S. Cl. ..... 343/840; 343/915

[58] Field of Search ..... 313/840, 912, 915

[56] References Cited

U.S. PATENT DOCUMENTS 1,703,870 3/1929 Demarest et al. ..... 343/840

OTHER PUBLICATIONS

Taco; Telemetry antennas with manual mounts; Jul. 1959; 2 pp., 343-840

*Primary Examiner*—Eli Lieberman

*Attorney, Agent, or Firm*—Richard G. Kinney

[57] ABSTRACT

An antenna structure, kit and method for making the structure comprising a generally circular base, a plurality of specially formed pre-stressed similarly shaped and sized arms which may be affixed in a disk array to the base and means, an arm encircling turnbuckel cable arrangement, for stressing the pre-stressed arms into a generally parabolic disk array is disclosed. The ribs are each made of a plurality of layers of resilient material, such as wood, which are bonded together in a bowed pre-stressed shape, which shape when modified by the stressing by the cable to assume a generally parabolic disk.

3 Claims, 4 Drawing Figures

ANTENNA ARM AND METHOD FOR MAKING THE ARM

This is a division of application Ser. No. 887,354, filed Mar. 16, 1978.

FIELD OF THE INVENTION

The present invention is directed to a novel antenna arm structure and arm for making the antenna arm structure.

BACKGROUND

It is known to make and use parabolic disk antenna for a number of applications. However, such antenna as are commercially available are relatively expensive and are often priced beyond the means of amateur radio astronomers or many people, such as those in isolated areas, who would wish to receive television or radio signals from satellite stations. For example, the antenna structure detailed in U.S. Pat. No. 2,485,881 is quite complex and would be too expensive for many individuals. Also many prior art antennae, such as that shown in U.S. Pat. No. 3,832,717, are usually constructed in such a manner as to require a permanent installation. While collapsable antennae have been suggested, e.g. U.S. Pat. No. 4,030,103, these tend to sacrifice performance by not being a full disk shape and tend to be relatively complex and expensive structures.

SUMMARY OF THE INVENTION

Against this background the present invention provides for a new and improved antenna arm and method for making the same. An arm constructed in accordance with the present invention includes a plurality of elongated normally linear flat members of resilient material, such as wood, which are bonded together in an arcuate flat surface to flat surface array, to form a bowed and pre-stressed unit.

The invention, together with the advantages thereof, may best be understood by reference to the following description taken in connection with the accompanying drawings, in the several figures of which like reference materials identify like elements.

DETAILED DESCRIPTION

Figure 1:
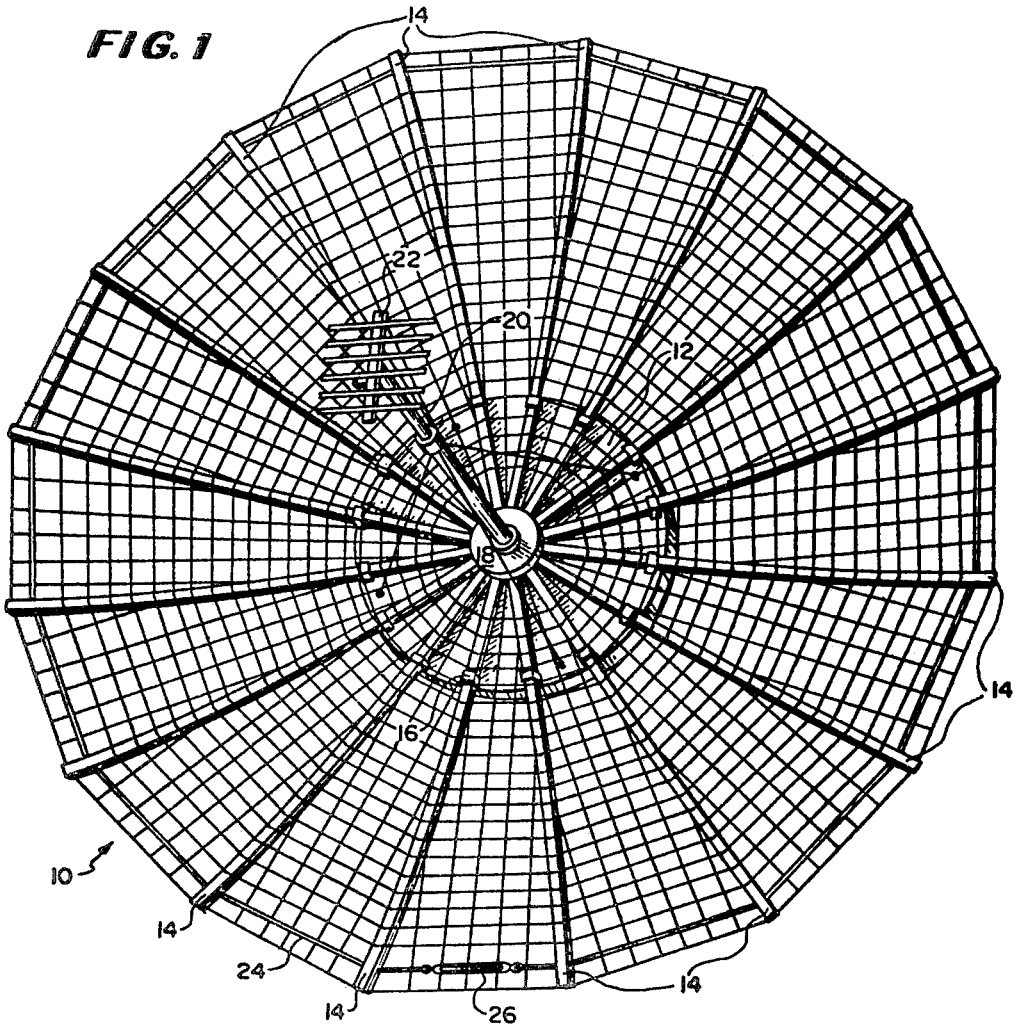
FIG. 1 is a perspective view of an antenna having arms constructed in accordance with the present invention.

Referring now to FIG. 1, there is depicted an assembled antenna including arm structures constructed in accordance with the principles of the present invention. The antenna is generally designated by the number 10. The antenna 10 includes a generally circular vertex plate or base 12, a plurality, in this case 16, of specially constructed arms 14 which radiate outward from the base 12 to form a disk array. The arms 14 are affixed to the base 12 by means of a plurality of sleeve members 16 in which the arms 14 and a clamping plate 18 which sandwiches the internal ends of the arms 16 between itself and the base 12. Though the center of the base 12 and plate 18 is a hole for accomodating a feed boom assembly 20 including a feed antenna 22 at the focus of the disk, defined by the arms 14. Means for stressing the arms 14 include a cable 24 which is received by the external ends of the arms 14 (through sleeves provided therein) and encircles the assembly and a turnbuckel 26 for tensioning the cable 24 and stressing and forming the arms 14 into the desired generally parabolic shape with a parabolic focus at feed antenna 22.

Figure 2:
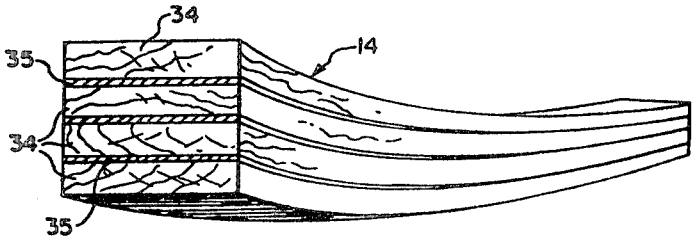
FIG. 2 is a sectional view of an arm of the antenna in FIG. 1.
Figure 3:
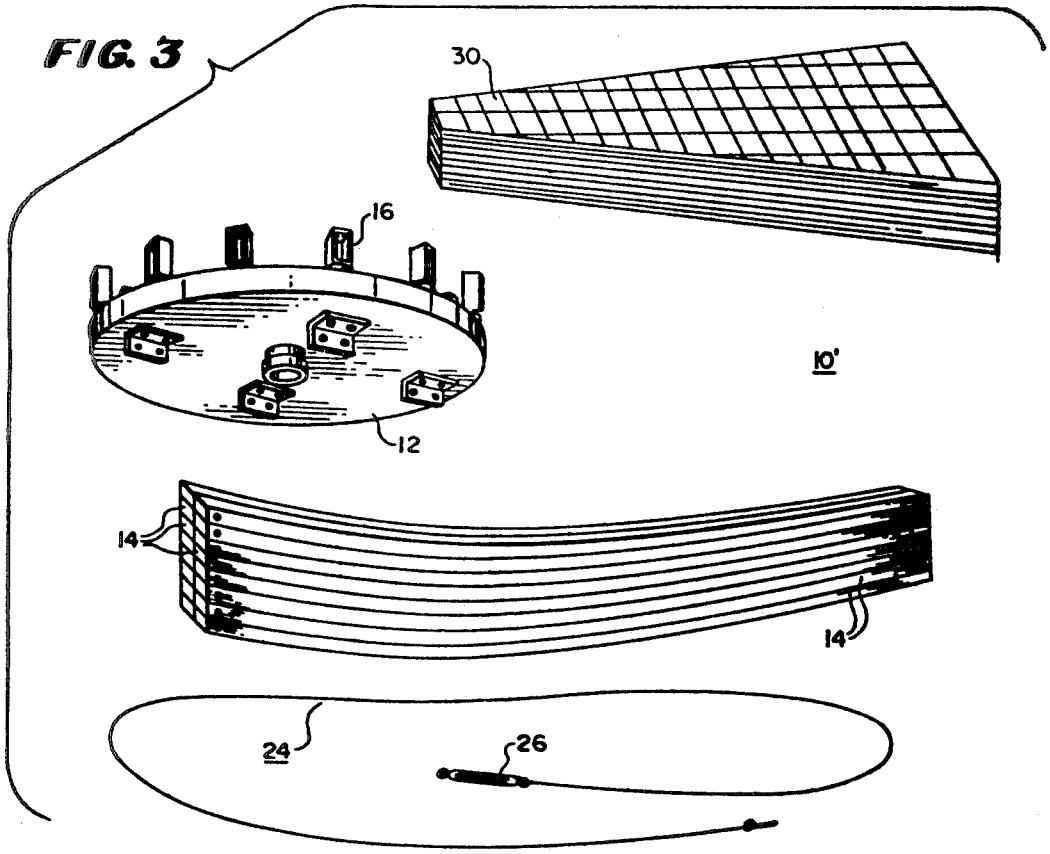
FIG. 3 is a perspective view of the arm of FIGS. 1 and 2 during different stages of construction.

More particularly the arms 14 are pre-stressed by being formed, as shown in Figures 2 and 3, of a plurality of layers 34 of resilient material such as wood bonded together in a bowed or curved arrangement. That is, each layer 34 is bonded by a suitable cement layer 35 to the arm below it. The arms are preferably formed by taking a plurality of layers 34, applying a slow drying cement 36 between them and then clamping the set of layers into a fixture which forces it to achieve the bowed or curved state and forces the layers into one another to assure the curved pre-stressed shape.

As shown in FIG. 3, the kit of parts 10' that can be employed are a set of substantially similar sized and shaped arms 14, base 12 with attaching means 16, 18 and tensioning means 24, 26. The kit may include radio wave reflecting sheets 30 or these may be fabricated and supplied by the assembler.

Figure 4:
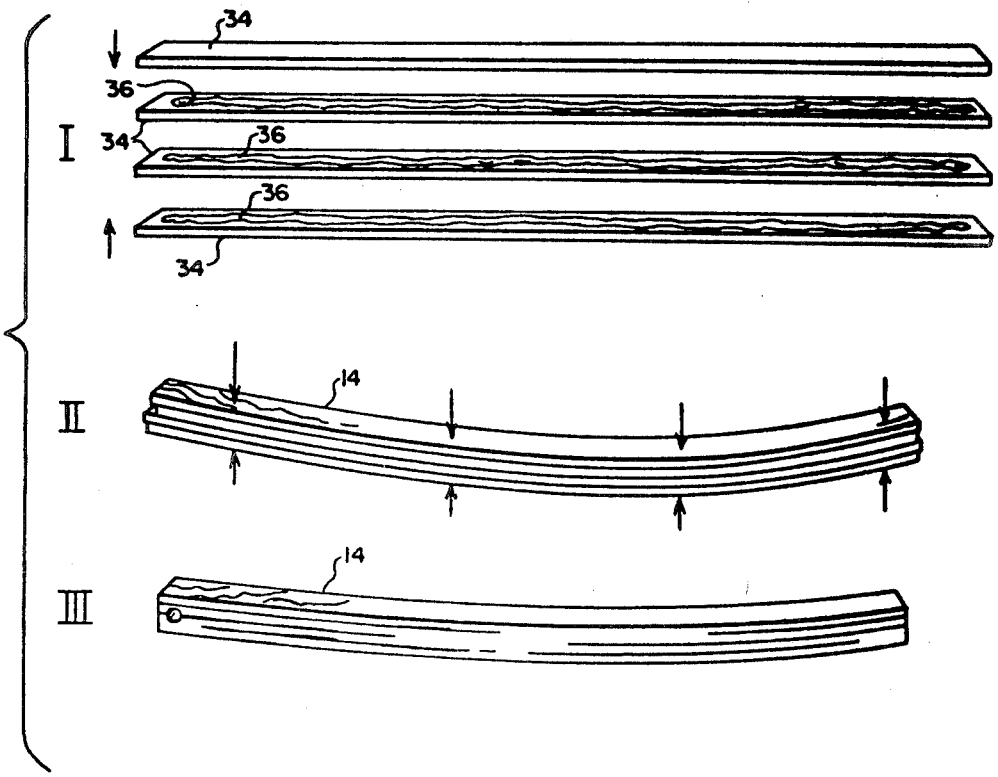
FIG. 4 is a perspective view of a kit of materials that may be used to assemble an antenna disk.

The method of constructing an arm 14 is shown in FIG. 4 wherein a plurality of normally flat elements 34 which are sized to the desired length of an arm 14, are sandwiched together with cement 36, e.g. marine epoxy, positioned between them and caused to assume a desired curvature as in (II) at the same time they are clamped together prior to the setting of the cement 36. This arrangement after finishing the outside and providing the whole receiving means yields the bowed arm 14 (III).

The shape of the finished pre-stressed arm 14 differs slightly from that of the captivated arm 14 of stage II and differs from that of the finished antenna (FIG. 1) such that the stressing or tension of the encircling cable results in a true parabolic shape.

As a concrete example, an antenna kit and antenna were constructed in accordance with the present invention with an overall size of 12 feet using antenna arms made of five layers 34 of white pine $1\frac{1}{4}$ inches wide and 7/16 inches thick, bonded with marine epoxy (such as Elmer's Waterproof Glue made by Borden Chemical Co.). The arms and layers are approximately 6 feet long.

The invention may be readily adapted to larger and smaller embodiments, however, which may use fewer or more arms 14. With increasing size the number of layers 34 are preferably increased; for example, six for a eight foot arm and seven layers for a ten foot arm.

In assembling the kit 10' of FIG. 4, one starts with the base 12, positions each of the sixteen arms 14 in place with the interior end between the plate and base, and passing through the sleeve. The sleeves are precisely positioned to help guide the arms to the right radial orientation. The assembler need only be sure that he puts the inside end into the base and has the arms bowing upward. The cable is then lead through the receiving means to encircle the arms attached to the turnbuckel. After checking and adjusting the alignment of the outer ends of the arms 14 (by for example, inserting a presized measuring elements between the ends of adjacent arms 14) the turnbuckel is tightened to stress the arms into the precise parabolic arrangement desired.

At this point the framework is complete and the reflecting material may be secured. It need only be positioned between the arms and affixed in place. For a semi-permanent construction it need only be stapled in place as the wood construction of the arms 14 readily accepts staples. For a less permanent installation the reflector sections 30 may be affixed in any convenient removable manner such as by wires twisted about the arms or removable screws or the like. The cable may be, for example, a vinyl coated ⅛ inch thick aircraft cable of 3600 pound breaking capacity. The screening 30 may be ordinary aluminum window screening but is preferably explaned aluminum (diamond mesh) or honeycomb perforated aluminum flat stock to withstand greater loading.

It should now be apparent that an extremely useful and advantageous antenna kit, structure and method of making the same has been described. The invention yields an economical result and is adaptable to a range of sizes and number of arms. The techniques illustrated may be easily adapted, for example, to 32 and 40 foot antenna. With increasing lengths of the arms the number of layers used and overall thickness is preferably increased. For example, 6 or 7 layers are used for arms of 8 and 10 feet, respectively.

While one particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of the invention.

The screening used in the panel 30 depends on the highest frequency anticipated for the frequency of transmission or broadcast. For example at 432 MHz ordinary chicken wire with a one inch opening will do. However, at 4 GHz a solid skin such as sheet metal is required. Expanded or perforated metal or welded wire fabric of appropriate sized perforations or openings can be used up to about 2.4 GHz to reduce wind loading or weight or cost.

Although the base has been depicted as having a solid plate (preferable of wood) for larger sized antenna structures a base made of a metal ring is prefered. The base is prefered to be about at least 30% to 45% of the antenna aperture in diameter.

I claim:

1. A parabolic disk antenna radial arm of the type that is to be used in a parabolic disk antenna, comprising a plurality of elongated normally flat elements of resilent material having smooth upper and lower normally flat surfaces, which are positioned in a flat surface to flat surface array and sandwiched and cemented to one another in an arcuate surface to surface arcuate configuration such that the arm is prestressed into a bowed configuration, said arm having one longitudinal end capable of being received and captivated by a disk antenna base and having its other longitudinal end adapted to receive a disk encircling captivating means.

2. The invention of claim 1 wherein said strips are of wood and are affixed together by a waterproof glue.

3. The method of making the arm of claim 1 comprising the steps of providing a plurality of elongated flat strips of a normally linear resilient material, positioning these strips into a sandwiched stacked flat surface to flat surface array with affixative sandwiched between the strips in an arcuate arrangement whereby the strips are affixed to one another by said affixative in a stressed bowed configuration, and adapting one longitudinal end of the arm to receive a disk encircling captivating means.

* * * * *